US010544636B1

(12) United States Patent
Vierke et al.

(10) Patent No.: US 10,544,636 B1
(45) Date of Patent: Jan. 28, 2020

(54) GUIDE PLATE FOR TUBULAR HANDLING TOOLS

(71) Applicant: FORUM US, INC., Houston, TX (US)

(72) Inventors: Andre Vierke, Hamburg (DE); Yusif Ibrahimov, Hamburg (DE); Victor Manuel Eslava Moreno, Hamburg (DE)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 16/030,121

(22) Filed: Jul. 9, 2018

(51) Int. Cl.

| | |
|---|---|
| ***E21B 19/07*** | (2006.01) |
| ***E21B 19/10*** | (2006.01) |
| ***E21B 19/24*** | (2006.01) |
| ***E21B 33/04*** | (2006.01) |
| ***E21B 41/10*** | (2006.01) |

(52) U.S. Cl.
CPC ..... *E21B 19/24* (2013.01); *E21B 19/07* (2013.01); *E21B 19/10* (2013.01); *E21B 33/04* (2013.01); *E21B 41/10* (2013.01)

(58) Field of Classification Search
CPC ..... E21B 19/07; E21B 19/10; E21B 19/24; E21B 33/04; E21B 41/10
See application file for complete search history.

(56) References Cited

U.S. PATENT DOCUMENTS

| | | | | |
|---|---|---|---|---|
| 6,994,176 | B2 * | 2/2006 | Shahin | E21B 7/20 166/77.52 |
| 7,509,722 | B2 * | 3/2009 | Shahin | E21B 19/16 166/85.1 |
| 9,234,395 | B2 * | 1/2016 | Angelle | E21B 19/07 |
| 9,988,862 | B2 * | 6/2018 | Triche | E21B 19/06 |
| 2016/0356104 | A1 * | 12/2016 | Vierke | E21B 19/07 |

* cited by examiner

*Primary Examiner* — Matthew R Buck
(74) *Attorney, Agent, or Firm* — Patterson + Sheridan, LLP

(57) ABSTRACT

A tubular handling tool includes a body having a center hole adapted to receive a tubular, a guide plate positioned about a top end and a bottom end of the center hole, and a plurality of rollers coupled to the guide plates. Each of the rollers are rotatable about a rotational axis that is parallel to a longitudinal axis of the center hole.

21 Claims, 8 Drawing Sheets

GUIDE PLATE FOR TUBULAR HANDLING TOOLS

BACKGROUND

Field

Embodiments disclosed herein relate to a guide plate for tubular handling tools.

Description of the Related Art

Tubular handling tools include elevators and spiders utilized in the oil and gas industry. A spider is a device that is configured to grip and suspend one or more tubular members from a rig into a wellbore. Typically, the tubular members are lowered into the spider, and a plurality of slips of the spider are actuated to grip the outer surface of the tubular member. An elevator is a device that is used to grip and raise/lower one or more tubular members relative to the rig and/or the wellbore. Typically, the elevator is positioned about the tubular member, and a plurality of slips of the elevator are actuated to grip the outer surface of the tubular member. The tubular members include casing, tubing, drill pipe, sucker rods, and the like, that are utilized on a rig operation.

Oftentimes, the tubular member is rotated while being located in the tubular handling tool but not being gripped by the slips. If the tubular member is not positioned at the correct angle relative to the tubular handling tool, then as the tubular member is rotated, it contacts the surrounding surfaces of the tubular handling tool and generates heat and wear marks on the tubular member and the tubular handling tool due to the friction between the contacting surfaces. Excessive wear of the tubular member and the tubular handling tool may damage and reduce the life of the tubular member and the tubular handling tool.

Therefore, there exists a need for new and improved tubular handling tools.

SUMMARY

In one embodiment, a tubular handling tool comprises a body having a center hole adapted to receive a tubular; an upper guide member positioned about an upper end of the center hole; a lower guide member positioned about a lower end of the center hole; and a plurality of rollers coupled to each guide member, wherein each of the rollers are rotatable about a rotational axis that is parallel to a longitudinal axis of the center hole.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include tubular handling tools utilized on an oil and gas rig and/or at an oil and gas wellsite. The tubular handling tools have a plurality of slips configured to grip tubular members. The tubular handling tools as described herein include an elevator and a spider but the embodiments disclosed herein can be used with other types of tubular handling tools with or without slips.

The tubular handling tools also have guide plates configured to reduce friction between the tubular handling tool and tubular members that are supported by the tubular handling tool. The guide plates are positioned about a center hole of the tubular handling tool and utilized to guide the tubular member therein. The guide plates also help protect the slips located within the tubular handling tool by maintaining the tubular member within the center hole and away from the slips when not gripping the tubular member.

Figure 1:
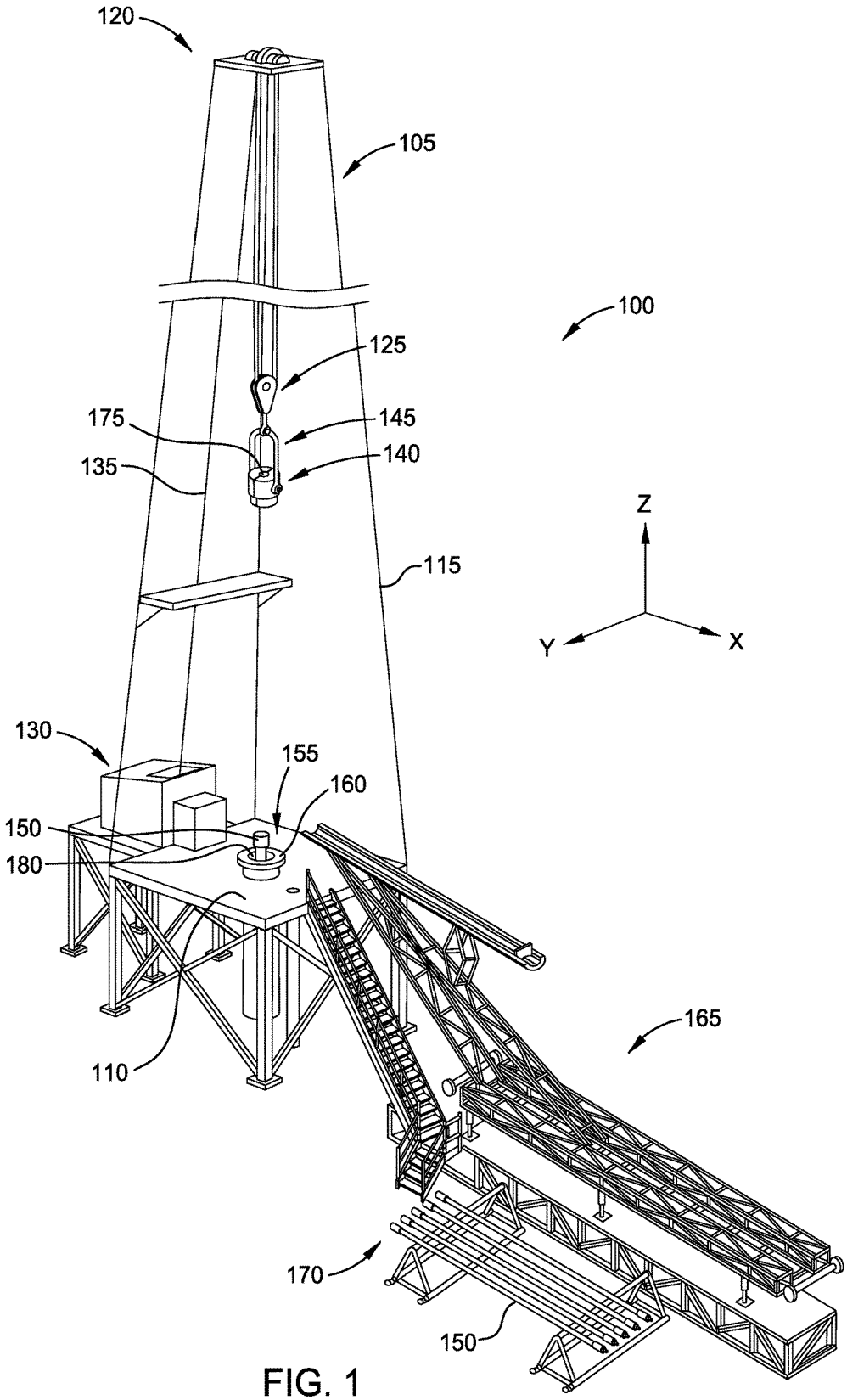
FIG. 1 illustrates one embodiment of a rig and various pieces of equipment located thereon.

FIG. 1 illustrates an oil and gas rig 100 having a mast 105 supported on a rig floor 110 by a frame 115, according to one embodiment. The mast 105 supports a crown block and sheave 120 from which a traveling block 125 is raised and lowered by a draw works 130 via a cable 135. A tubular handling tool, such as an elevator 140, is suspended from the traveling block 125 by a bail 145 and is used to raise and lower one or more tubulars 150. A rotary table 155 is disposed in the rig floor 110 and contains another tubular handling tool, such as a spider 160, from which one or more tubulars 150 are suspended.

A catwalk 165 transfers the tubulars 150 from a pipe rack 170 to the rig floor 110. Each tubular 150 is positioned by the catwalk 165 in a substantially horizontal orientation (e.g. along the X-Y plane), where one end of the tubular 150 is gripped by the elevator 140 and subsequently raised to a substantially vertical orientation (e.g. along the Z-axis) for coupling with another tubular held by the spider 160. After the tubulars 150 are coupled together, the elevator 140 releases its grip on the tubular 150 but remains positioned about the tubular 150 to prevent it from toppling over.

The tubular 150 is then rotated, such as by the rotary table 155, and lowered into the wellbore. If the elevator 140 is not properly oriented with respect to the tubular 150 then frictional contact between the tubular 150 and the elevator 140 as the tubular 150 is rotated causes excessive wear to the tubular 150 and/or the elevator 140. Similarly, if the spider 160 is not properly oriented with respect to the tubular 150 then frictional contact between the tubular 150 and the spider 160 as the tubular 150 is rotated causes excessive wear to the tubular 150 and/or the spider 160.

The longitudinal axis of the tubular 150 may not be oriented at a 90 degree angle relative to the horizontal axis of the elevator 140 and/or the spider 160 (e.g. relative to the X-Y plane) such that contact between the tubular 150 and the elevator 140 and/or the spider 160 occurs. For example, the longitudinal axis of the tubular 150 may be oriented at an 80 degree or 65 degree angle relative to the horizontal axis of the elevator 140 and/or the spider 160 (e.g. relative to the X-Y plane).

Figure 2:
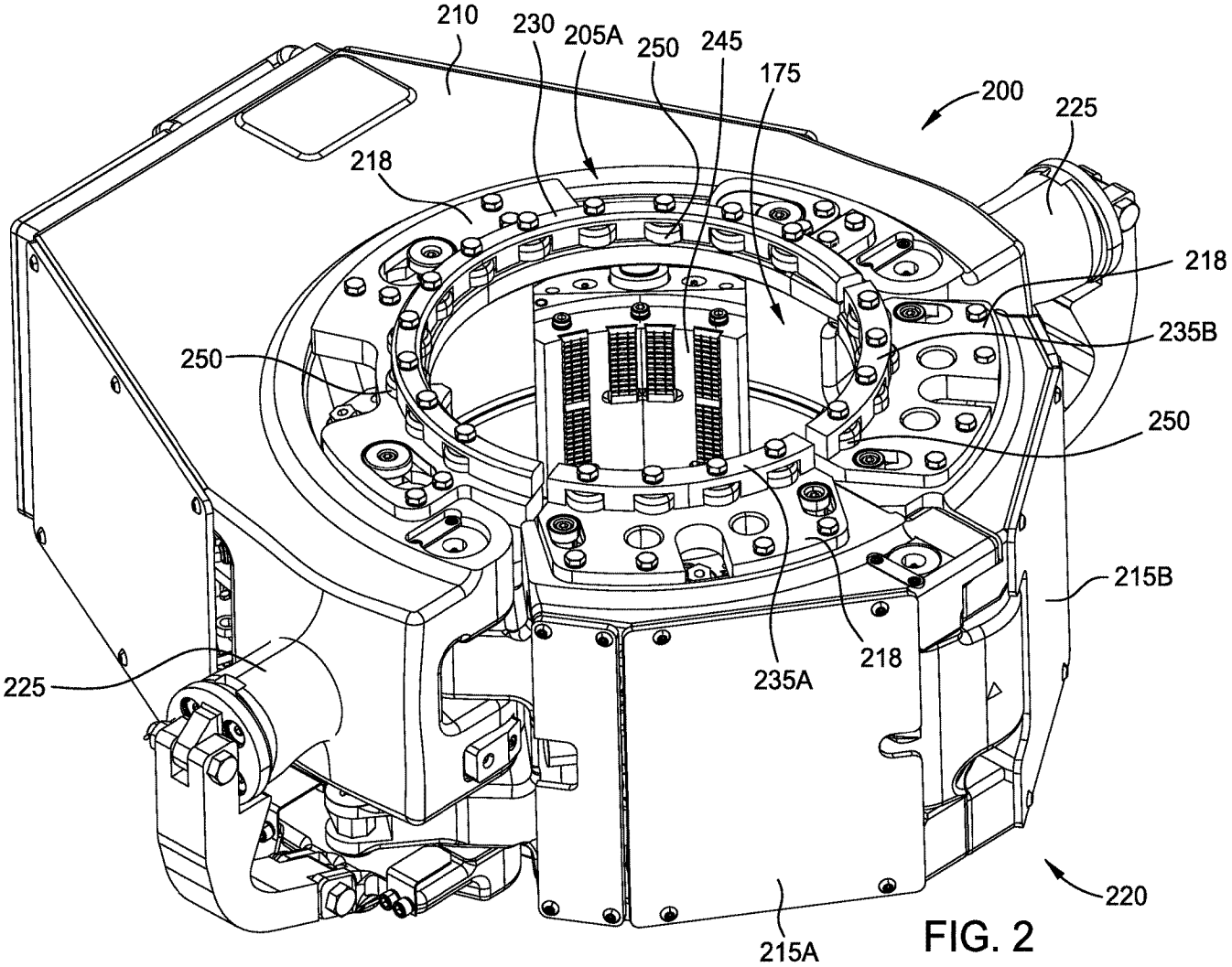
FIG. 2 is a perspective view of the top end of a tubular handling tool according to one embodiment.
Figure 3:
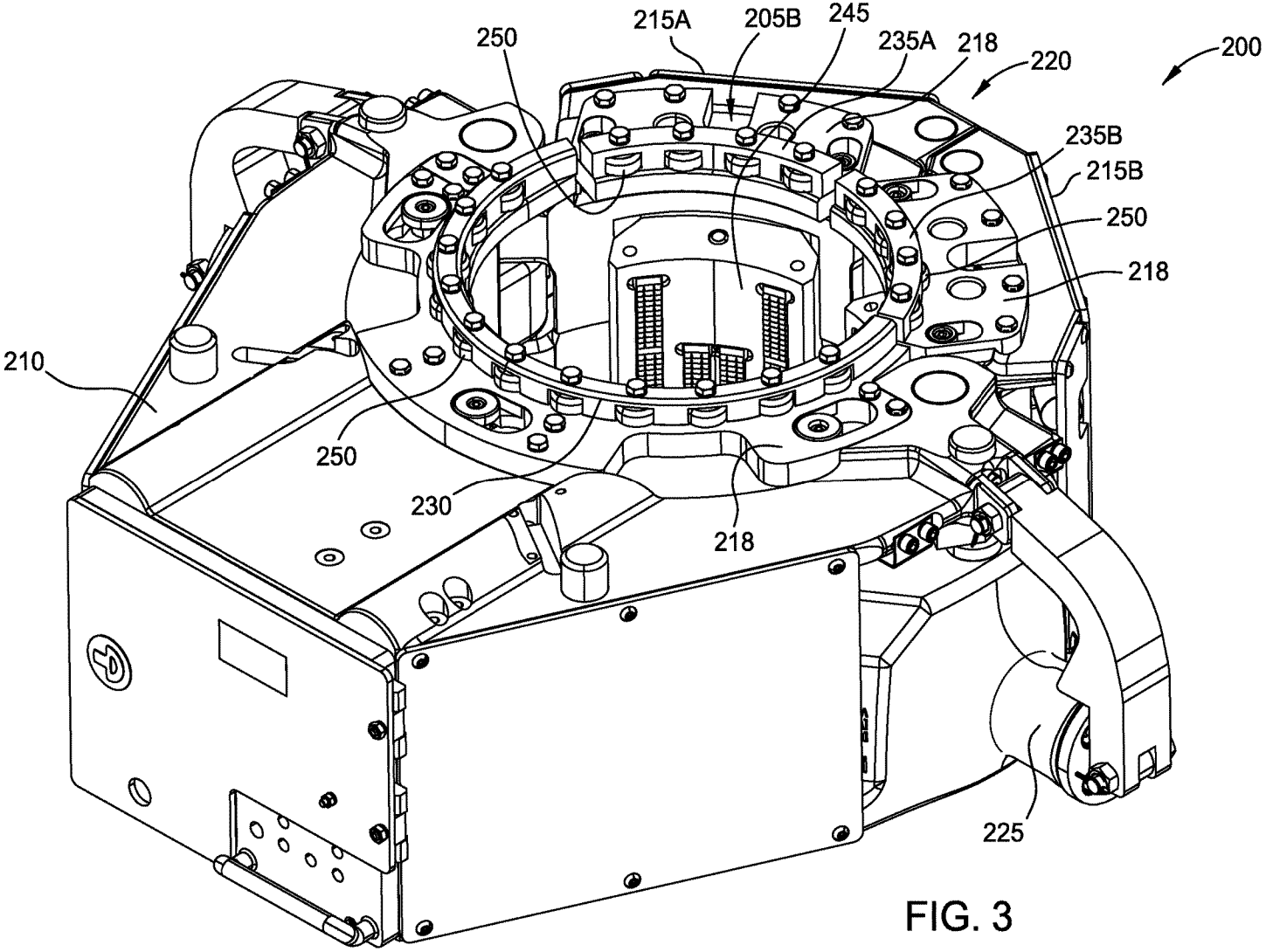
FIG. 3 is a perspective view of the bottom end of the tubular handling tool of FIG. 2.
Figure 4:
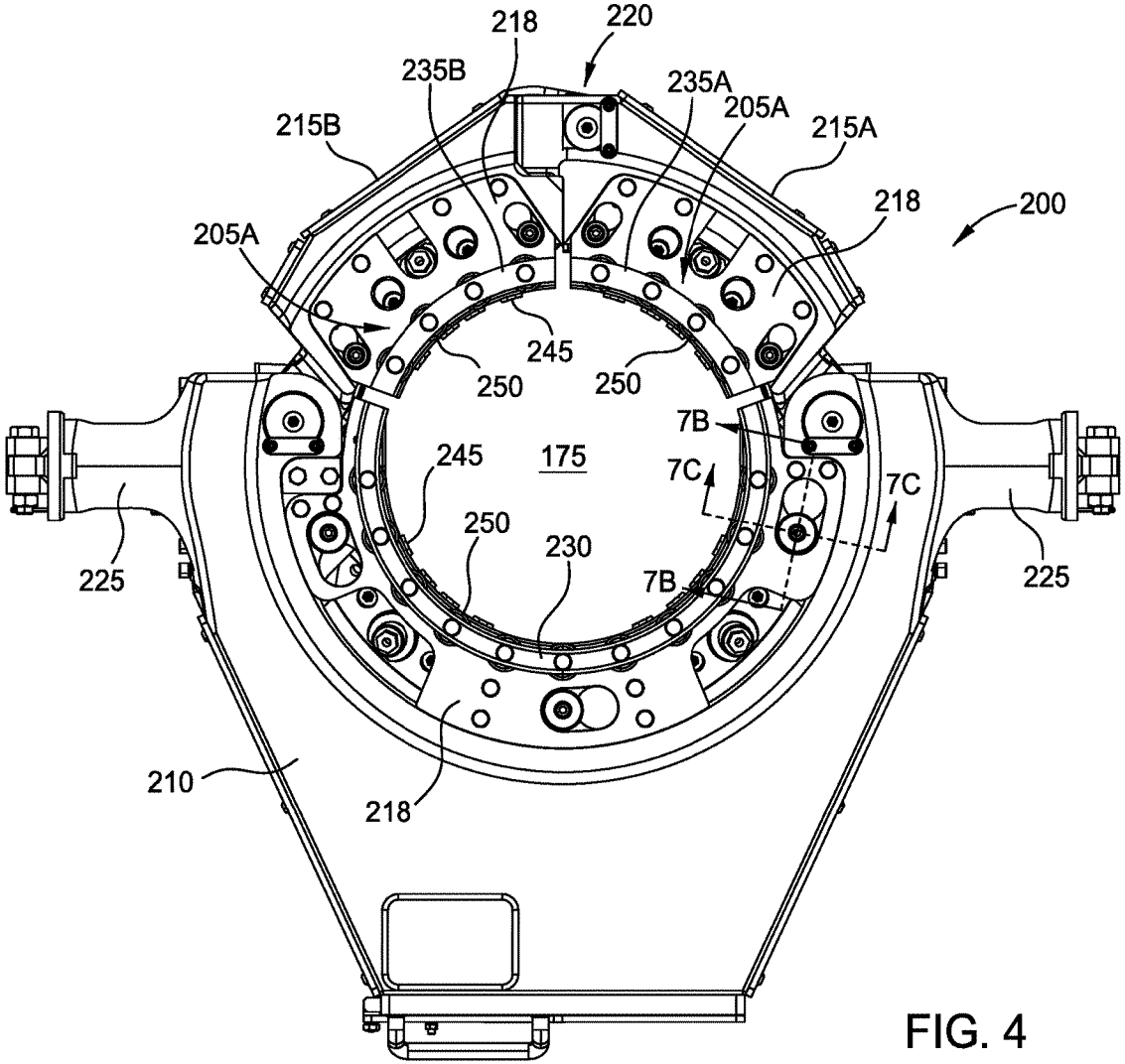
FIG. 4 is a top plan view of the tubular handling tool of FIG. 2.

FIGS. 2-4 are various views of a tubular handling tool 200 that may be utilized as the elevator 140 of FIG. 1. Although the tubular handling tool 200 is described herein as being utilized as the elevator 140 as shown in FIG. 1, the embodiments disclosed herein can be equally used with the spider 160 as shown in FIG. 1, as well as with other types of tubular handling tools with or without slips.

FIG. 2 is a perspective view of a top end of the tubular handling tool 200. FIG. 3 is a perspective view of a bottom end of the tubular handling tool 200. FIG. 4 is a top plan view of the tubular handling tool 200.

The tubular handling tool 200 includes an upper guide member 205A (shown in FIGS. 2 and 4) and a lower guide member 205B (shown in FIG. 3) disposed about a circumference of a center hole 175 of the tubular handling tool 200. The upper guide members 205A are disposed about an upper end of the center hole 175 of the tubular handling tool 200 on the top side of the tubular handling tool 200. The lower guide members 205B are disposed about a lower end of the center hole 175 of the tubular handling tool 200 on the bottom side of the tubular handling tool 200.

The tubular handling tool 200 includes a body 210 and a pair of door members 215A and 215B that are hingedly coupled to the body 210. Each of the door members 215A and 2158 can be moved between an open position to allow a tubular to be located in the center hole 175 and a closed position to secure the tubular within the center hole 175. The opening members 215A and 215B may be secured by a latch mechanism 220 to keep the opening members 215A and 215B closed and the tubular secured therein. The body 210 includes two hooks 225 adapted to receive the bail 145 that is coupled to the traveling block 125 as shown in FIG. 1.

Each of the guide members 205A and 205B include a first roller mounting plate 230, a second roller mounting plate 235A, and a third roller mounting plate 235B. The roller mounting plates 230, 235A, 235B of the upper guide member 205A are positioned about the top end of the center hole 175. The roller mounting plates 230, 235A, 235B of the lower guide member 205B are positioned about the bottom end of the center hole 175.

Each of the first roller mounting plates 230, the second roller mounting plates 235A, and the third roller mounting plates 235B are arc-shaped members formed in a radius that is substantially the same as a diameter of the center hole 175 of the tubular handling tool 200. Each of the first roller mounting plates 230 are coupled to the body 210 by upper and lower guide plates 218, respectively. Each of the second roller mounting plates 235A and third roller mounting plates 235B are coupled to the door members 215A and 215B by respective upper and lower guide plates 218. Each of the upper and lower guide plates 218 are coupled to the body 210 and/or the opening members 215A, 215B by one or more fasteners as described in more detail in FIGS. 7A-7C.

The tubular handling tool 200 also includes one or more slips 245. Each of the slips 245 are independently or collectively actuatable to move toward a center of the center hole 175. Each of the slips 245 include a plurality of teeth that are utilized to grip an outer surface of a tubular.

Each of the first roller mounting plates 230, the second roller mounting plates 235A, and the third roller mounting plates 235B include one or more rollers 250 coupled to the roller mounting plates and the guide plates 218. Each of the rollers 250 freely rotate about a rotational axis that is parallel to a longitudinal axis of the center hole 175 of the tubular handling tool 200 (e.g. parallel to the Z-axis). It is noted that in FIG. 4, the slips 245 are shown in a set position such that the slips 245 extend inwardly past an inner surface of the rollers 250. In the set position the slips 245 would be gripping a tubular that extends through the tubular handling tool 200.

Figure 5A:
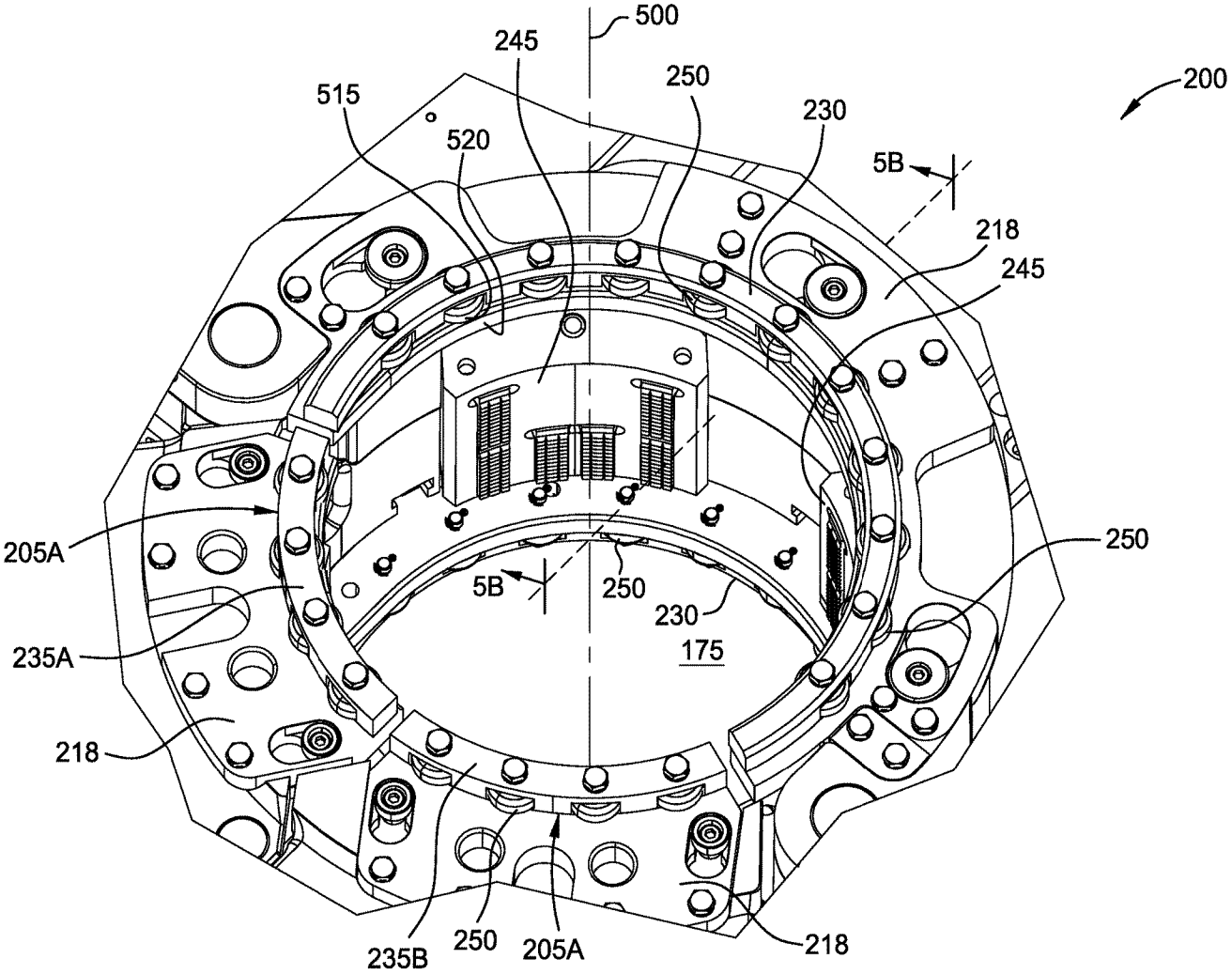
FIG. 5A is a perspective view of a portion of the tubular handling tool shown in FIG. 2.
Figure 5B:
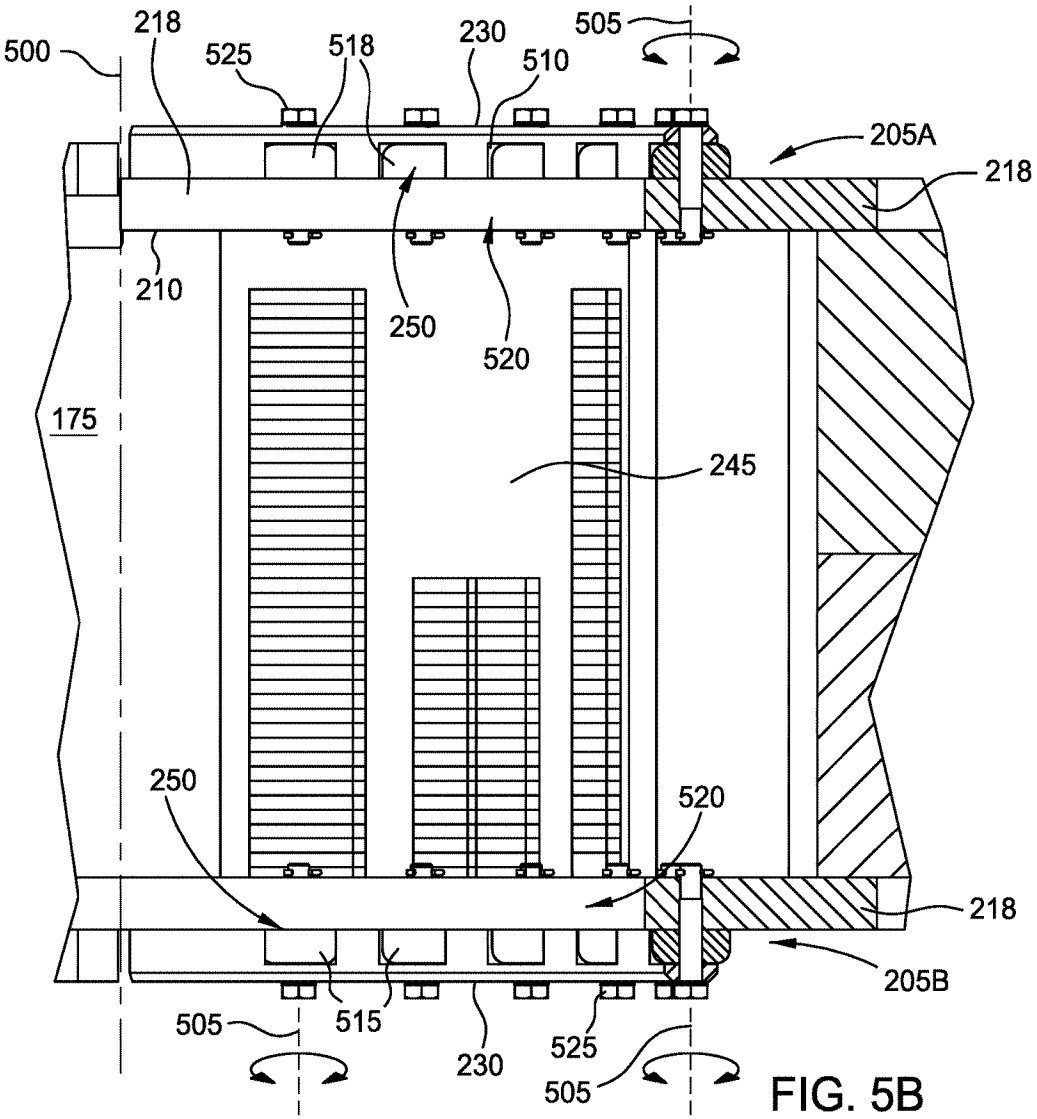
FIG. 5B is a sectional view of the tubular handling tool taken along lines 5B-5B of FIG. 5A.

FIG. 5A is a perspective view of a portion of the tubular handling tool 200. FIG. 5B is a sectional view of the tubular handling tool taken along lines 5B-5B of FIG. 5A.

A longitudinal axis 500 is shown through the center of the center hole 175 of the tubular handling tool 200 in FIG. 5A. FIG. 5B shows a rotational axis 505 for some of the rollers 250. The rotational axis 505 is parallel to the longitudinal axis 500 of the tubular handling tool 200. Although the rotational axis 505 of only three rollers 250 is shown in FIG. 5B, all of the rollers 250 are rotatable about a rotational axis parallel to the longitudinal axis 500 of the tubular handling tool 200.

The first roller mounting plate 230 is shown on a top side and a bottom side of the tubular handling tool 200 in FIG. 5B. Each of the first roller mounting plates 230 include a plurality of openings 510 within which the rollers 250 are located such that at least a portion 515 of the rollers 250 extends radially inward within a circumferential inner surface 520 of the guide plates 218 and/or within the inner diameter of the center hole 175. The portions 515 of the rollers 250 are adapted to contact an outer surface of a tubular and prevent the tubular from contacting the circumferential inner surface 520 of the guide plates 218, as well as to prevent inadvertent contact with the slips 245 when not gripping the tubular. The portions 515 of the rollers 250 also allow rotation of the tubular relative to the tubular handling tool 200 with reduced friction if the tubular is not aligned with the longitudinal axis 500 of the center hole 175 of the tubular handling tool 200.

The first roller mounting plate 230 is coupled to the body 210 by fasteners 525, such as pins or bolts. Each of the fasteners 525 may be fit bolts. Each of the plurality of openings 510 function as a secondary retention mechanism, and in particular are sized such that the rollers 250 are secured within the first roller mounting plate 230 so that if a fastener 525 breaks the roller 250 cannot fall out of the opening 510. Each of the second and third roller mounting plates 235A, 235B include openings similar to the openings 510 of the first roller mounting plates 230 and are coupled with fasteners 525.

Figure 6A:
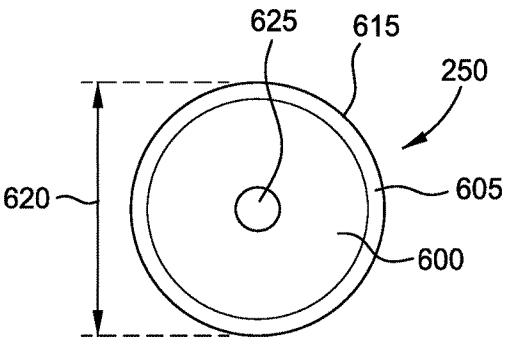
FIG. 6A is a top plan view of a roller of the tubular handling tool according to one embodiment.
Figure 6B:
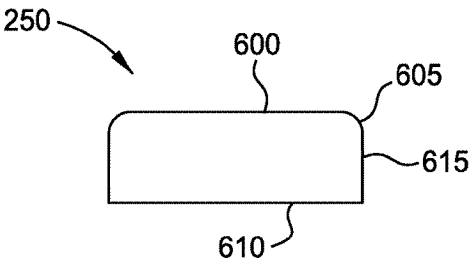
FIG. 6B is a side view of the roller of FIG. 6A.

FIG. 6A is a top plan view of one roller 250. FIG. 6B is a side view of the roller 250. The roller 250 includes a body having a top surface 600, a bottom surface 610, and a side surface 615. The roller 250 as shown in FIG. 6B would be installed in the guide members 205A on top of the tubular handling tool 200, while the rollers 250 installed in the guide members 205B on the bottom of the tubular handling tool 200 would be rotated 180 degrees from the position shown in FIG. 6B.

The side surfaces 615 are configured to contact a tubular located within the center hole 175 of the tubular handling tool 200. A radius 605 is formed between the top surface 600 and the side surface 615. The radius 605 is configured to prevent snagging of the tubular by the rollers 250 when the tubular moves through the center hole 175 of the tubular handling tool 200.

The roller 250 has a diameter 620 and a through hole 625 that is sized to rotate freely about the fastener 525 (as shown in FIG. 5B). The diameter 620 can be chosen based on the size of the tubular handling tool 200 and/or the size of the center hole 175. The rollers 250 can be made from a metallic material, such as steel, stainless steel, aluminum, or other suitable metal.

Figure 7A:
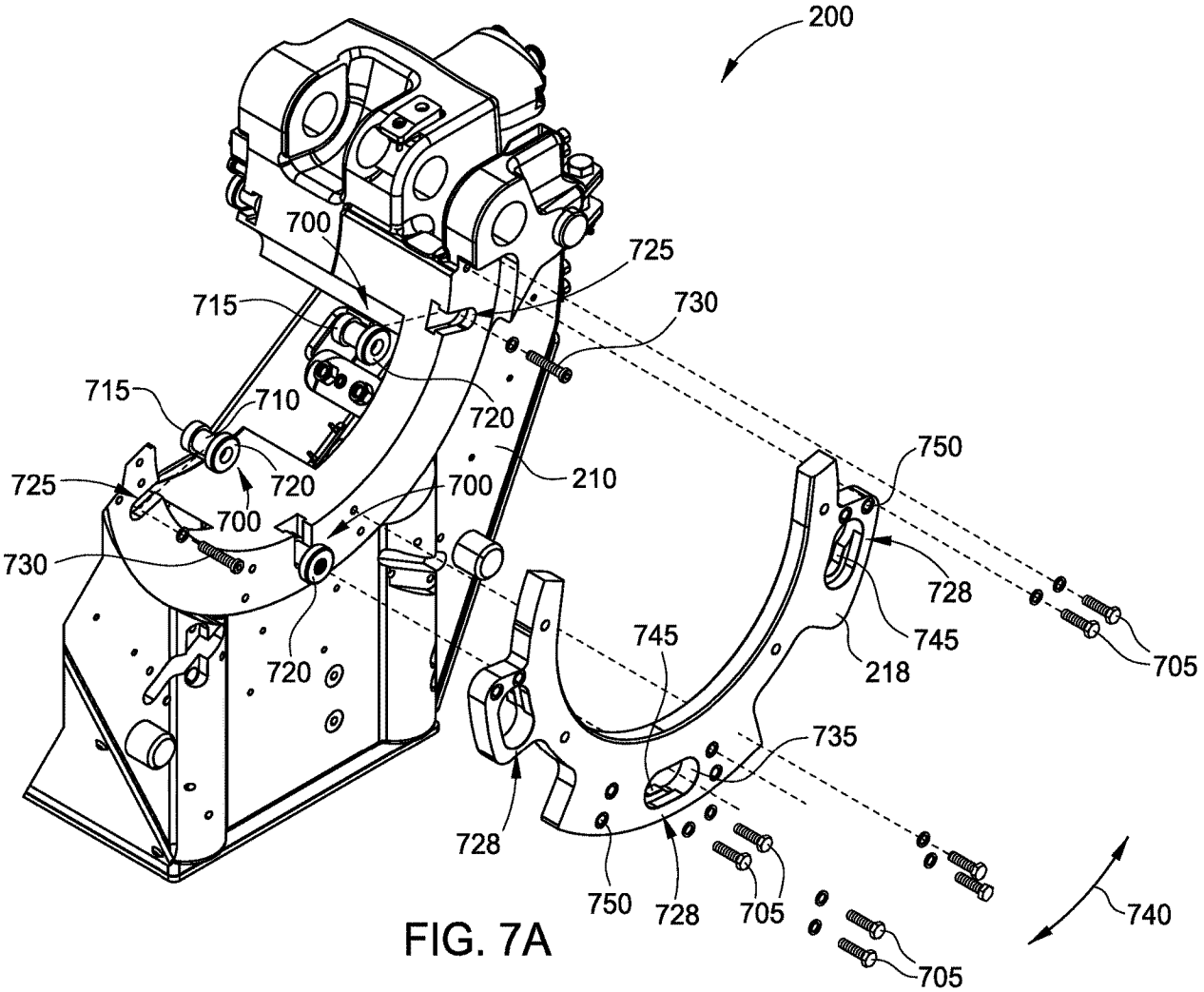
FIG. 7A is an isometric view of a portion of the tubular handling tool showing one guide plate exploded away from the body.

FIG. 7A is an isometric view of a portion of the tubular handling tool 200 showing one guide plate 218 exploded away from the body 210. The guide plate 218 is coupled to the body 210 by a plurality of fasteners shown as first connectors 700 and second connectors 705. The guide plates 218 are used to couple the roller mounting plates to the body 210 and the opening members 215A, 215B.

Each of the first connectors 700 are in the form of a spool-shaped member having an inner portion 710 surrounded by a first outer portion 715 and a second outer portion 720 located at opposite ends. The inner portion 710 includes a dimension (e.g., a diameter) that is less than a dimension (e.g., a diameter) of both of the first outer portion 715 and the second outer portion 720.

Each of the first connectors 700 are received in a slot 725 formed in the body 210. The slot 725 may be a linear shaped slot. A portion of the inner portions 710 and the first outer portions 715 of each of the first connectors 700 is inserted in the slot 725. Once the first connectors 700 are positioned in the slots 725, a fastener 730 is inserted through the each of the first connectors 700 and coupled to the body 210.

The guide plate 218 is positioned adjacent to the body 210 where the second outer portion 720 of each of the first connectors 700 can be inserted into an opening 728 formed in the guide plate 218. The opening 728 may be an oblong shaped opening formed in the guide plate 218. The opening 728 has a non-slotted portion 735 and a slotted portion 745. The second outer portion 720 of the first connectors 700 are inserted into the non-slotted portion 735 of the opening 728. Thereafter, one or both of the body 210 and the guide plate 218 is rotated slightly in the direction of arrow 740 such that the second outer portion 720 of each of the first connectors 700 is seated within the slotted portion 745 of the opening 728.

Once rotated fully, the fasteners 730 may be fully tightened against the body 210 to couple the guide plate 218 to the body 210. The second connectors 705, which may be bolts, are then coupled to the body 210 through additional openings 750 formed in the guide plate 218 to further couple the guide plate 218 to the body 210. One of the first connectors 700 and the second connectors 705 function as a secondary retention mechanism in order to prevent the guide plate 218 from falling away from the body 210.

Figure 7C:
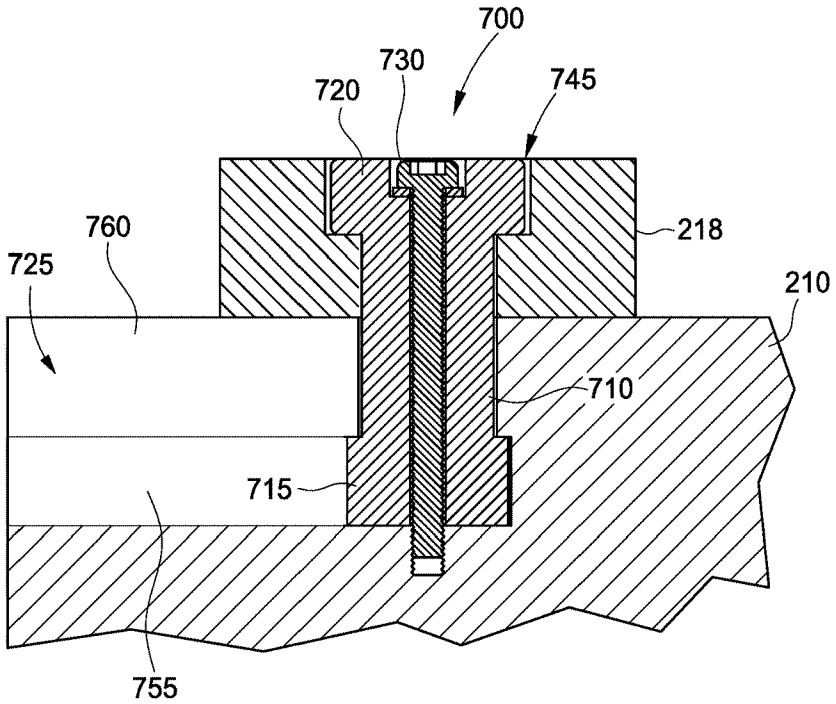
FIGS. 7B and 7C are partial sectional views of the tubular handling tool along lines 7B-7B and lines 7C-7C, respectively, of FIG. 4.
Figure 7B:
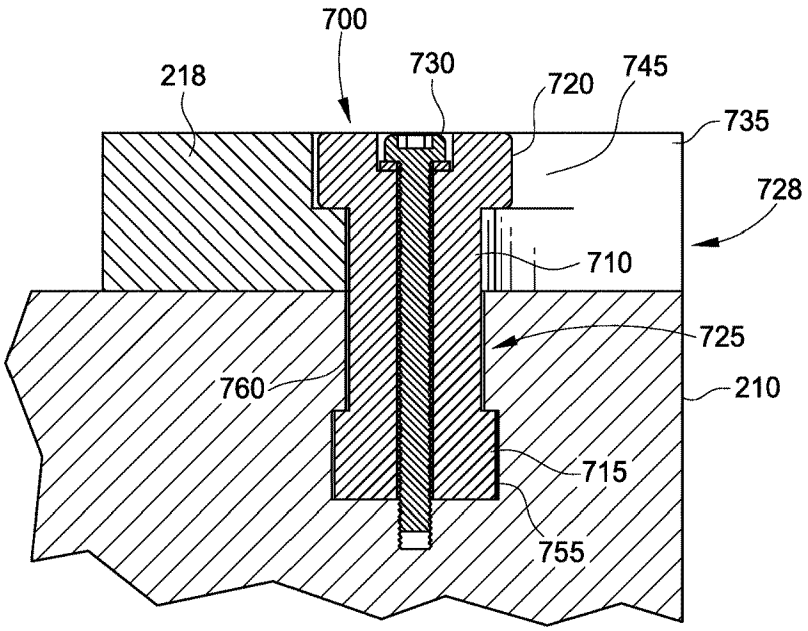

FIGS. 7B and 7C are partial sectional views along lines 7B-7B and lines 7C-7C of FIG. 4. The guide plate 218 is shown coupled to the body 210 by the first connectors 700. FIG. 7B shows the slotted portion 745 and a portion of the non-slotted portion 735 of the opening 728. FIGS. 7B and 7C show the slot 725 formed in the body 210. The slot 725 includes a first channel 755 and a second channel 760 sized to receive the first outer portion 715 and the second outer portion 720, respectively, of the first connector 700. The first channel 755 has a dimension (e.g., a width) that is greater than a dimension (e.g., a width) of the second channel 760.

While the foregoing is directed to embodiments of the disclosure, other and further embodiments of the disclosure thus may be devised without departing from the basic scope thereof, and the scope thereof is determined by the claims that follow.

The invention claimed is:

1. A tubular handling tool, comprising:

a body having a center hole adapted to receive a tubular;

an upper guide member positioned about an upper end of the center hole, the upper guide member having a plurality of upper roller mounting plates each having a plurality of openings formed in a circumferential inner surface of the respective upper roller mounting plate of the plurality of upper roller mounting plates;

a lower guide member positioned about a lower end of the center hole; and a plurality of rollers coupled to each guide member, wherein each roller of each respective plurality of rollers is rotatable about a rotational axis that is parallel to a longitudinal axis of the center hole, and each opening of each respective plurality of openings includes one roller of the respective plurality of rollers positioned therein.

2. The tubular handling tool of claim 1, further comprising a plurality of slips coupled to the body and configured to grip the tubular when located in the center hole.

3. The tubular handling tool of claim 1, wherein the body further includes a pair of door members that are hingedly coupled to the body and configured to secure the tubular within the center hole.

4. The tubular handling tool of claim 1, wherein a first portion of each roller of each respective plurality of rollers extends radially inward and inside of the respective inner circumferential surface of the respective upper roller mounting plate, and a second portion of each roller of each respective plurality of rollers extends radially outward and outside of an outer circumferential surface of the respective upper roller mounting plate.

5. The tubular handling tool of claim 4, wherein the lower guide member includes a plurality of lower roller mounting plates each having a plurality of openings formed in a circumferential inner surface of the respective lower roller mounting plate of the plurality of lower roller mounting plates.

6. The tubular handling tool of claim 5, wherein each opening of each respective plurality of openings includes one roller positioned therein.

7. The tubular handling tool of claim 6, wherein a first portion of each roller in the plurality of lower roller mounting plates extends radially inward and inside of the respective inner circumferential surface of the respective lower roller mounting plate, and a second portion of each roller in the plurality of lower roller mounting plates extends radially outward and outside of an outer circumferential surface of the respective lower roller mounting plate.

8. The tubular handling tool of claim 1, wherein the tubular handling tool is an elevator configured to raise and lower the tubular.

9. The tubular handling tool of claim 1, wherein each of the upper guide member and the lower guide member are coupled to the body by a guide plate.

10. The tubular handling tool of claim 1, wherein each roller of each respective plurality of rollers is configured to rotate about a fastener disposed through a through hole of the respective roller and through an upper surface of the respective upper roller mounting plate of the plurality of upper roller mounting plates.

11. The tubular handling tool of claim 10, wherein each roller of each respective plurality of rollers includes a height and a diameter, and the diameter is greater than the height.

12. A tubular handling tool, comprising:

a body having a center hole adapted to receive a tubular;

an upper guide member positioned about an upper end of the center hole and mounted to the body by an upper guide plate, the upper guide member having a plurality of upper roller mounting plates each having a plurality of openings formed in a circumferential inner surface of the respective upper roller mounting plate of the plurality of upper roller mounting plates;

a lower guide member positioned about a lower end of the center hole and mounted to the body by a lower guide plate; and a plurality of rollers coupled to each guide member, wherein each roller of each respective plurality of rollers is rotatable about a rotational axis that is parallel to a longitudinal axis of the center hole, and each opening of each respective plurality of openings includes one roller of the respective plurality of rollers positioned therein.

13. The tubular handling tool of claim 12, wherein the lower guide member includes a plurality of lower roller mounting plates each having a plurality of openings formed in a circumferential inner surface of the respective lower roller mounting plate of the plurality of lower roller mounting plates.

14. The tubular handling tool of claim 13, wherein each opening of each respective plurality of openings includes one roller positioned therein.

15. The tubular handling tool of claim 12, wherein each roller of each respective plurality of rollers is configured to rotate about a fastener disposed through a through hole of the respective roller and through an upper surface of the respective upper roller mounting plate of the plurality of upper roller mounting plates.

16. The tubular handling tool of claim 15, wherein each roller of each respective plurality of rollers includes a height and a diameter, and the diameter is greater than the height.

17. A tubular handling tool, comprising:

a body having a center hole adapted to receive a tubular;

an upper guide member positioned about an upper end of the center hole and mounted to the body by an upper guide plate, the upper guide member having a plurality of upper roller mounting plates each having a plurality of openings formed in a circumferential inner surface of the respective upper roller mounting plate of the plurality of upper roller mounting plates;

a lower guide member positioned about a lower end of the center hole and mounted to the body by a lower guide plate; and a plurality of rollers coupled to each guide member, wherein each roller of each respective plurality of rollers is rotatable about a rotational axis that is parallel to a longitudinal axis of the center hole, wherein both of the upper guide plate and the lower guide plate are coupled to the body by a plurality of first connectors, and each opening of each respective plurality of openings includes one roller of the respective plurality of rollers positioned therein.

18. The tubular handling tool of claim 17, wherein the first connectors include a portion that is inserted in a slot formed in the body, and wherein the first connectors include another portion that is inserted into a slot formed in the upper or lower guide plate.

19. The tubular handling tool of claim 17, wherein the upper and lower guide plates are coupled to the body by a plurality of second connectors.

20. The tubular handling tool of claim 17, wherein each roller of each respective plurality of rollers is configured to rotate about a fastener disposed through a through hole of the respective roller and through an upper surface of the respective upper roller mounting plate of the plurality of upper roller mounting plates.

21. The tubular handling tool of claim 20, wherein each roller of each respective plurality of rollers includes a height and a diameter, and the diameter is greater than the height.

* * * * *